US012674616B2

(12) United States Patent
Park et al.

(10) Patent No.: US 12,674,616 B2
(45) Date of Patent: Jul. 7, 2026

(54) REFRIGERATED TRAILERS

(71) Applicant: HYUNDAI TRANSLEAD, San Diego, CA (US)

(72) Inventors: Young Jae Park, Chula Vista, CA (US); Alvaro Frausto, San Diego, CA (US); Martin Martinez-Contreras, San Diego, CA (US); Enrique Chavez, Chula Vista, CA (US); Joseph Enright, El Cajon, CA (US); Victor Vargas, Jr., La Mesa, CA (US); Frederic Graham, Spring Valley, CA (US)

(73) Assignee: HYUNDAI TRANSLEAD, San Diego, CA (US)

( * ) Notice: Subject to any disclaimer, the term of this patent is extended or adjusted under 35 U.S.C. 154(b) by 66 days.

(21) Appl. No.: 18/394,559

(22) Filed: Dec. 22, 2023

(65) Prior Publication Data

US 2025/0102219 A1 Mar. 27, 2025

Related U.S. Application Data

(60) Provisional application No. 63/540,583, filed on Sep. 26, 2023.

(51) Int. Cl.
*F25D 23/06* (2006.01)
*F25D 11/00* (2006.01)

(52) U.S. Cl.
CPC ..... *F25D 23/065* (2013.01); *F25D 11/003* (2013.01); *F25D 2201/126* (2013.01); *F25D 2201/14* (2013.01)

(58) Field of Classification Search
CPC .... F25D 23/065; F25D 23/066; F25D 23/067; F25D 23/06; F25D 11/003; F25D 11/00; F25D 2201/126; F25D 2201/12; F25D 2201/10; F25D 2201/14; B65D 81/3813; B65D 81/38; B65D 81/3804; B65D 81/3816; B65D 81/3823
USPC ..... 220/592.09, 592.1, 592.25, 592.2, 1.5
See application file for complete search history.

(56) References Cited

U.S. PATENT DOCUMENTS 3,181,311 A * 5/1965 Latzer ..... F25D 23/061 220/62.19
3,242,625 A * 3/1966 Tillinghast ..... B62D 33/048 52/404.3
3,357,585 A * 12/1967 Morrison ..... F17C 13/001 521/146

(Continued)

FOREIGN PATENT DOCUMENTS

CA 1328724 C * 4/1994 ..... F01N 3/2889

*Primary Examiner* — Robert J Hicks
(74) *Attorney, Agent, or Firm* — Knobbe, Martens, Olson & Bear, LLP

(57) ABSTRACT

A refrigerated trailer having thermal insulation, including: a plurality of side walls, wherein each side wall includes: a first plurality of vacuum insulated panels (VIPs), each VIP of the first plurality of VIPs made of thermal resistant and porous material; and a roof including: a second plurality of VIPs, each VIP of the second plurality of VIPs made of thermal resistant and porous material; a second plurality of structural posts, each structural post of the second plurality of structural posts made of composite material, the second plurality of structural posts arranged in a horizontal bow configuration to hold the second plurality of VIPs in place to form a roof.

21 Claims, 7 Drawing Sheets

100

150

(56) References Cited

U.S. PATENT DOCUMENTS

| | | | | |
|---|---|---|---|---|
| 4,196,950 | A * | 4/1980 | Churchill | B32B 7/025 428/319.1 |
| 4,659,132 | A * | 4/1987 | Day | B60P 3/055 296/186.4 |
| 2006/0277938 | A1* | 12/2006 | Meyer | F25D 11/003 312/401 |
| 2015/0338153 | A1* | 11/2015 | Zhao | F16M 1/08 248/676 |
| 2023/0382625 | A1* | 11/2023 | Ros | B65D 81/3823 |

* cited by examiner

200

250

500

550

700

REFRIGERATED TRAILERS

CROSS-REFERENCE TO RELATED APPLICATIONS

This application claims the benefit of priority under 35 U.S.C. § 119 (e) of U.S. Provisional Patent Application No. 63/540,583, filed Sep. 26, 2023, entitled "Reefer Trailers." The disclosure of the above-referenced application is incorporated herein by reference.

BACKGROUND

Field of the Invention

The present disclosure relates generally to trailers, and more specifically, to improved refrigerated trailers.

Background

Existing refrigerated trailer sidewalls and roofs are assembled using thermoplastic liners, metal skins (e.g., aluminum), structural metal members, mechanical fasteners, and insulation foam with a thickness of walls and roofs ranging from 2" to 4". The insulation foam may be applied using spray/injection methods. However, the existing refrigerated trailers may be improved by enhancing the thermal properties of its product using design changes and material selection on its roof and sidewalls.

SUMMARY

The present disclosure describes an improved refrigerated trailer.

In one implementation, a refrigerated trailer having thermal insulation is disclosed. The refrigerated trailer includes: (1) a plurality of side walls, wherein each side wall includes: (a) a first plurality of Vacuum Insulated Panel (VIP) s, each VIP made of ultra-thin, high-performing insulants made up of a rigid, highly-porous core material encased in a thin, gas-tight outer envelope; (b) a first plurality of structural posts, each structural post made of composite material, the first plurality of structural posts arranged in a vertical configuration to hold the plurality of VIPs in place to form a wall; (2) a roof including: (a) a second plurality of VIPs; (b) a second plurality of structural posts, each structural post made of composite material, the second plurality of structural posts arranged in a horizontal bow configuration to hold the second plurality of VIPs in place to form a roof.

In another implementation, a refrigerated trailer includes: (1) a pair of side walls, each side wall including: (a) first multiple VIPs, wherein each VIP is made of insulants made up of a rigid, highly-porous core material encased in a thin, gas-tight outer envelope; (b) composite wall posts arranged in a vertical configuration to hold the first multiple VIPs in place to form the pair of side walls; and (2) a roof including: (a) second multiple VIPs, wherein each VIP is made of insulants made up of a rigid, highly-porous core material encased in a thin, gas-tight outer envelope; (b) composite roof posts arranged in a horizontal bow configuration to hold the second multiple VIPs in place to form the roof.

Other features and advantages of the present disclosure should be apparent from the present description which illustrates, by way of example, aspects of the present disclosure.

BRIEF DESCRIPTION OF THE DRAWINGS

The details of the present disclosure, both as to its structure and operation, may be gleaned in part by study of the appended drawings, in which like reference numerals refer to like parts, and in which.

DETAILED DESCRIPTION

As stated above, sidewalls and roofs for an existing refrigerated trailer are assembled using thermoplastic liners, metal skins (e.g., aluminum), structural metal post members, mechanical fasteners, and insulation foam with a thickness of walls and roofs ranging from about 2" to 4". Further, it should be noted that the structural metal post members may create thermal bridges between inside and outside of the trailer.

To improve the design of the existing refrigerated trailers, certain implementations of the present disclosure provide for using vacuum insulated panels (VIPs) and composite structural members. Using the VIPs in place of standard insulation foams may create a thinner wall with thickness of about 0.5-1.5" but with equivalent or better thermal properties than standard 2"-4" insulated foam wall. Further, the use of non-metallic composite structural post members as oppose to industry standard metallic structure posts avoids potential thermal bridges between the inside and outside of the trailer. The design improvement may also include using adhesive to fasten the walls together rather than the industry standard of mechanical fasteners.

Accordingly, after reading this description it will become apparent how to implement the present disclosure in various implementations and applications. Although various implementations of the present disclosure will be described herein, it is understood that these implementations are presented by way of example only, and not limitation. As such, this detailed description of various implementations should not be construed to limit the scope or breadth of the present disclosure.

Figure 1A:
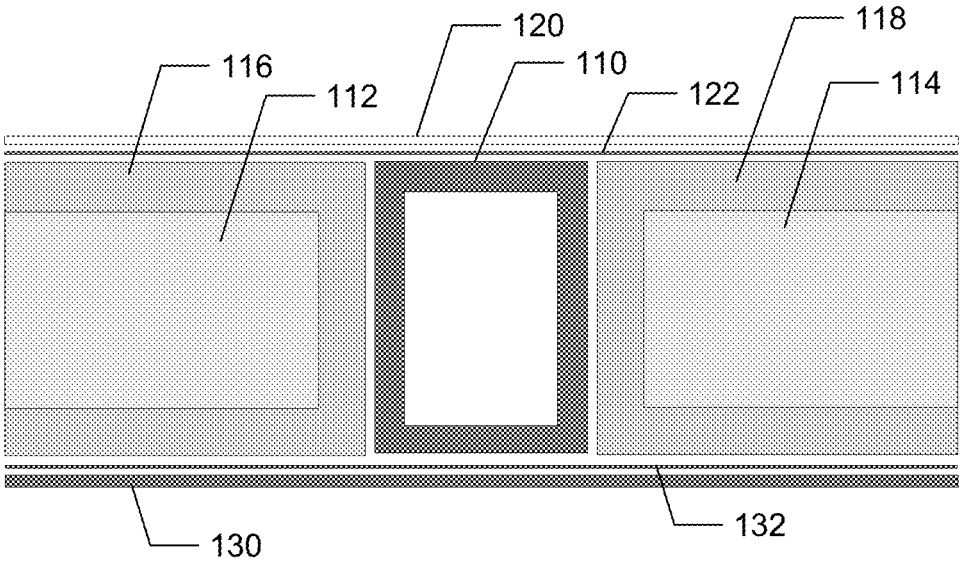
FIG. 1A is a cross-sectional view of a side wall of a refrigerated trailer having thermal insulation including a composite structural post and vacuum insulated panels in accordance with a first implementation of a side wall of the present disclosure.

FIG. 1A is a cross-sectional view of a side wall 100 of a refrigerated trailer having thermal insulation including a composite structural post 110 and vacuum insulated panels (VIPs) 112, 114 in accordance with a first implementation of a side wall of the present disclosure. A VIP is made of ultra-thin, high-performing insulants made up of a rigid, highly-porous core material encased in a thin, gas-tight outer envelope.

In another implementation, each of the VIPs 112, 114 is encapsulated using polyurethane (PU) foam 116, 118. As indicated above, the existing structural posts may be made of metallic material which acts as thermal bridges between the inside and the outside of the trailer. In contrast, by using the composite structural post 110, potential thermal bridges between the inside and outside may be avoided, while improving thermal insulation properties. In this implementation, the composite structural post 110 is a square shape. It should be noted that different shape type posts provide different types of structural support, fastening options and weight savings.

In one implementation, the side wall 100 also includes an outside skin 120 of an aluminum sheet and an inside skin 130 of a thermoplastic liner. In one implementation, adhesives 122, 132 (rather than the industry standard of mechanical fasteners) are used to attach the composite structural post 110 and the VIPs 112, 114 (may include the PU foam 116, 118) to the inside skin 130 and the outside skin 120 of the side wall 100.

Figure 1B:
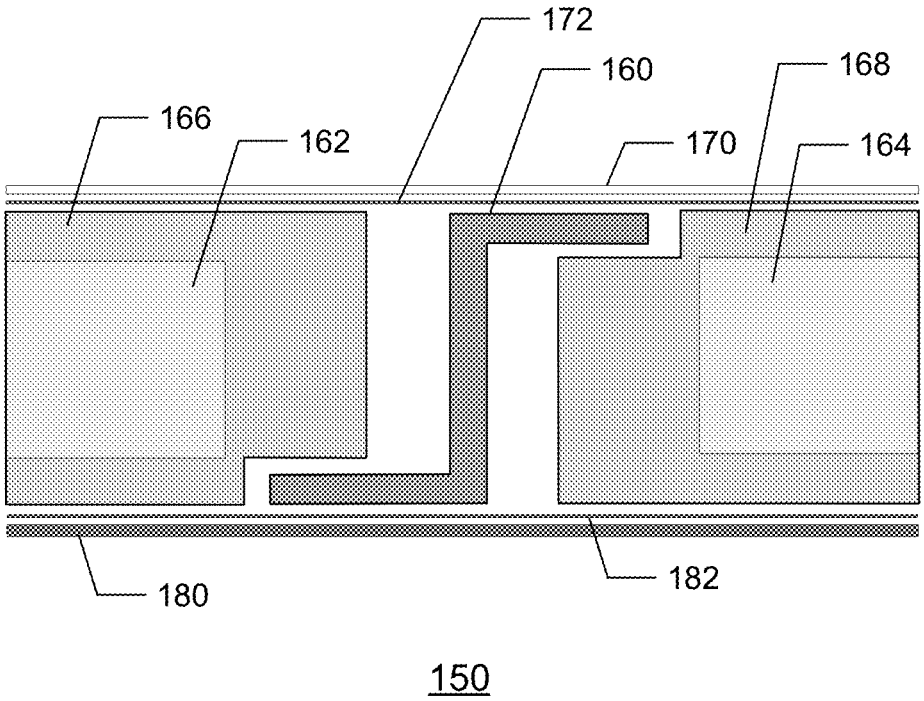
FIG. 1B is a cross-sectional view of a side wall of a refrigerated trailer having thermal insulation including a composite structural post and vacuum insulated panels in accordance with a second implementation of a side wall of the present disclosure.

FIG. 1B is a cross-sectional view of a side wall 150 of a refrigerated trailer having thermal insulation including a composite structural post 160 and vacuum insulated panels (VIPs) 162, 164 in accordance with a second implementation of a side wall of the present disclosure. As with the first implementation, each of the VIPs 162, 164 may be encapsulated using PU foam 166, 168. In the second implementation of the side wall, the composite structural post 160 is a Z-shape. In contrast to the square shape, Z-shape removes air space in between square posts, which increases thermal properties of entire wall and provides ease of installation. As stated above, by using the composite structural post 160, potential thermal bridges between the inside and outside may be avoided, while improving thermal insulation properties. In one implementation, the side wall 150 also includes an outside skin 170 of an aluminum sheet and an inside skin 180 of a thermoplastic liner. In one implementation, adhesives 172, 182 (rather than the industry standard of mechanical fasteners) are used to attach the composite structural post 160 and the VIPs 162, 164 (may include the PU foam 166, 168) to the inside skin 180 and the outside skin 170 of the side wall 150.

Figure 2A:
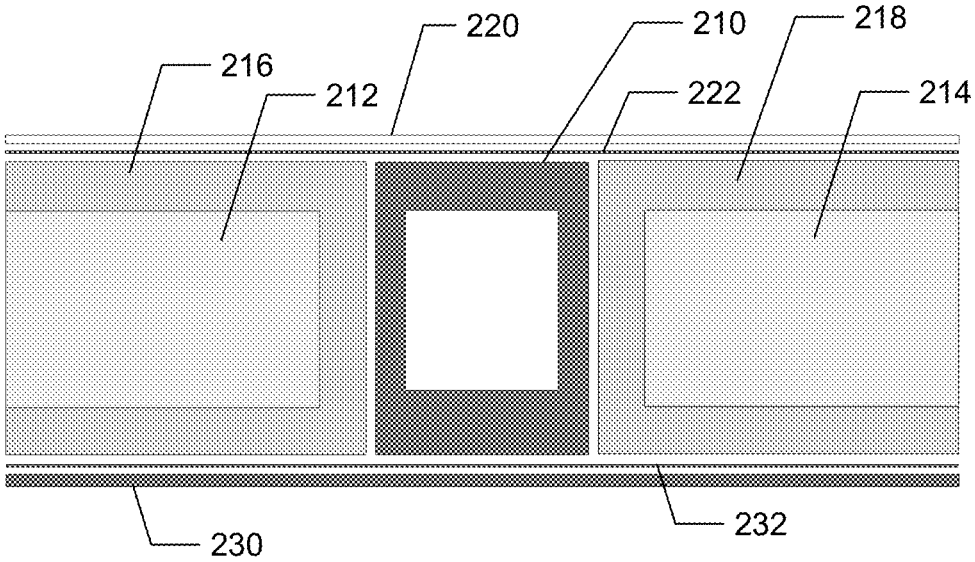
FIG. 2A is a cross-sectional view of a roof of the refrigerated trailer having thermal insulation including a composite structural post and VIPs in accordance with a first implementation of the roof of the present disclosure.

FIG. 2A is a cross-sectional view of a roof 200 of the refrigerated trailer having thermal insulation including a composite structural post 210 and VIPs 212, 214 in accordance with a first implementation of the roof of the present disclosure. As stated above for the side wall, the VIP is made with highly thermal resistant and porous material having a thin core. In another implementation, each of the VIPs 212, 214 is encapsulated using PU foam 216, 218. As indicated above for the side wall, the composite structural post 210 provides improved thermal insulation properties. In this implementation, the composite structural post 210 is a square shape looking down from the top, while it is curved in a bow shape looking from the back of the trailer. In another implementation, the roof 200 also includes an outside skin 220 of an aluminum sheet and an inside skin 230 of a thermoplastic liner. In one implementation, adhesives 222, 232 (rather than the industry standard of mechanical fasteners) are used to attach the composite structural post 210 and the VIPs 212, 214 (may include the PU foam 216, 218) to the inside skin 230 and the outside skin 220 of the roof 200.

Figure 2B:
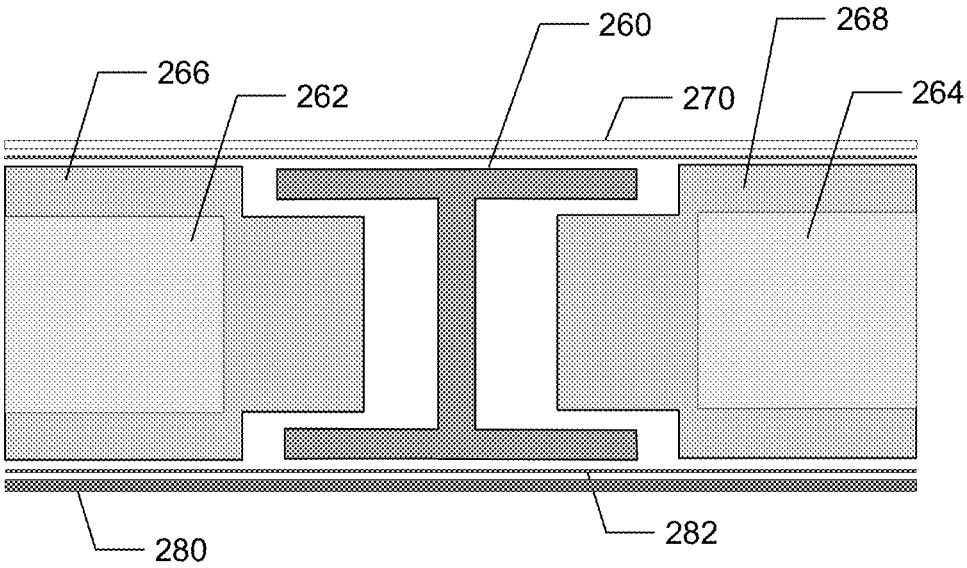
FIG. 2B is a cross-sectional view of a roof of a refrigerated trailer having thermal insulation including a composite structural post and VIPs in accordance with a second implementation of a roof of the present disclosure.

FIG. 2B is a cross-sectional view of a roof 250 of a refrigerated trailer having thermal insulation including a composite structural post 260 and VIPs 262, 264 in accordance with a second implementation of the roof of the present disclosure. As with other implementations, each of the VIPs 262, 264 may be encapsulated using PU foam 266, 268. In the second implementation of the roof, the composite structural post 160 is an I-beam shape. This shape (compared to the square shape) removes air space in between square posts, which increases thermal properties of the entire wall. This shape also increases the structural integrity.

The I-beam shape of the post 260 also provides ease of installation and structural integrity. In one implementation, the roof 250 also includes an outside skin 270 of an aluminum sheet and an inside skin 280 of a thermoplastic liner. In one implementation, adhesives 272, 282 (rather than the industry standard of mechanical fasteners) are used to attach the composite structural post 260 and the VIPs 262, 264 (may include the PU foam 266, 268) to the inside skin 280 and the outside skin 270 of the roof 250.

Figure 3A:
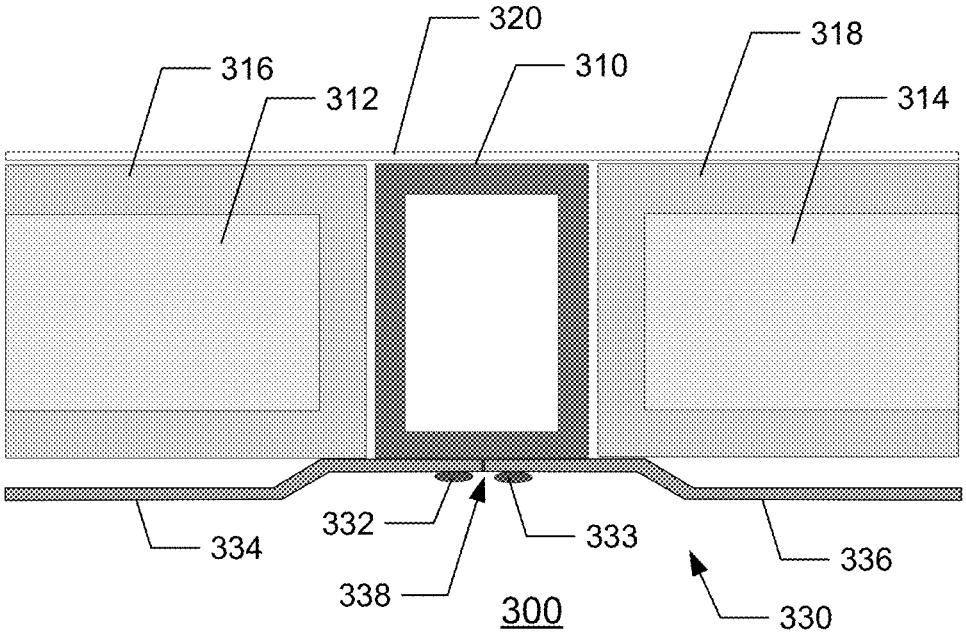
FIG. 3A is a cross-sectional view of a side wall of a refrigerated trailer having thermal insulation including a composite structural post and VIPs in accordance with a third implementation of a side wall of the present disclosure.

FIG. 3A is a cross-sectional view of a side wall 300 of a refrigerated trailer having thermal insulation including a composite structural post 310 and VIPs 312, 314 in accordance with a third implementation of the side wall of the present disclosure. A VIP is made with highly thermal resistant and porous material having a thin core. In one implementation, each of the VIPs 312, 314 is encapsulated using PU foam 316, 318. As indicated above, by using the composite structural post 310, potential thermal bridges between the inside and outside may be avoided, while improving thermal insulation properties. In the third implementation of the side wall, the side wall 300 also includes an outside skin 320 of an aluminum sheet and an inside skin 330 of a composite liner. In the third implementation of the side wall, the inside skin 330 of the composite liner includes multiple pieces 334, 336 bent and joined at a joint 338 using fasteners 332, 333. The fasteners 332, 333 may be made of composite or metallic material.

Figure 3B:
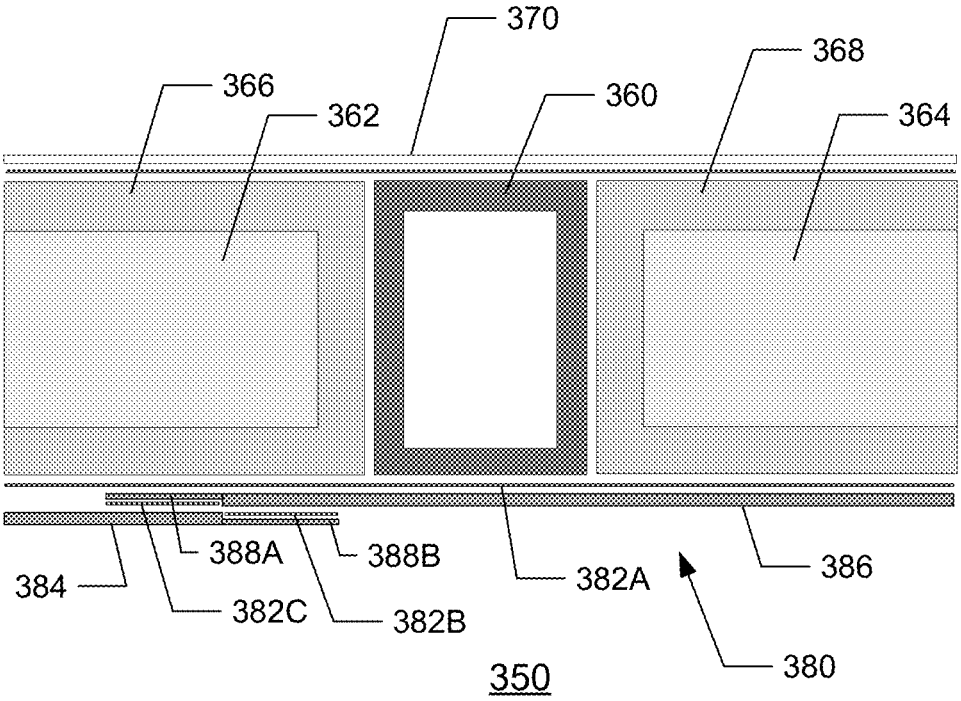
FIG. 3B is a cross-sectional view of a side wall of a refrigerated trailer having thermal insulation including a composite structural post and VIPs in accordance with a fourth implementation of a side wall of the present disclosure.

FIG. 3B is a cross-sectional view of a side wall 350 of a refrigerated trailer having thermal insulation including a composite structural post 360 and VIPs 362, 364 in accordance with a fourth implementation of the side wall of the present disclosure. As with the first implementation of the side wall, each of the VIPs 362, 364 may be encapsulated using PU foam 366, 368.

In the fourth implementation of the side wall, the side wall 350 also includes an outside skin 370 of an aluminum sheet and an inside skin 380 of a composite liner. In the fourth implementation of the side wall, the inside skin 380 of the composite liner includes multiple pieces 384, 386 joined using lap joints 388A, 388B. In one implementation, adhesives 382A, 382B, 382C are used to the liners to the inside skin 380. In one implementation, the composite liner is a liner made of composite material including combination of thermoplastic, aluminum, metallic, and non-metallic material.

Figure 4:
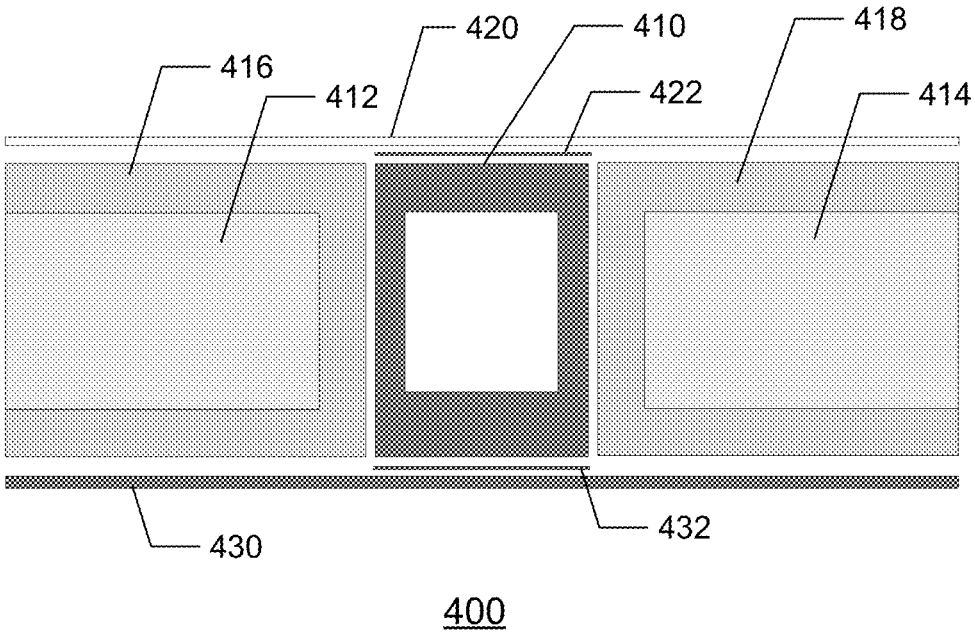
FIG. 4 is a cross-sectional view of a side wall of a refrigerated trailer having thermal insulation including a composite structural post and VIPs in accordance with a fifth implementation of the side wall of the present disclosure.

FIG. 4 is a cross-sectional view of a side wall 400 of a refrigerated trailer having thermal insulation including a composite structural post 410 and VIPs 412, 414 in accordance with a fifth implementation of the side wall of the present disclosure. As with the first implementation, each of the VIPs 412, 414 may be encapsulated using PU foam 416, 418.

In the fifth implementation of the side wall, adhesives 422, 432 are used to attach the composite structural post 410 only to the inside skin 430 and the outside skin 420.

Figure 5A:
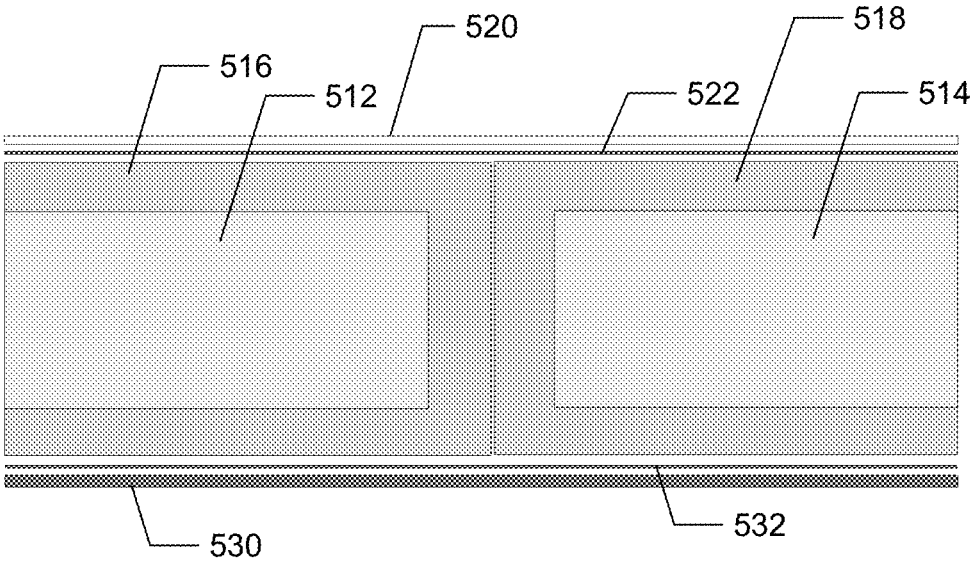
FIG. 5A is a cross-sectional view of a side wall of a refrigerated trailer having thermal insulation including VIPs in accordance with a sixth implementation of the side wall of the present disclosure.

FIG. 5A is a cross-sectional view of a side wall (or roof) 500 of a refrigerated trailer having thermal insulation including VIPs 512, 514 in accordance with a sixth implementation of the side wall of the present disclosure. As with the first implementation, each of the VIPs 512, 514 may be encapsulated using PU foam 516, 518. However, the sixth implementation of the side wall does not include a composite structural post.

In the sixth implementation of the side wall, adhesives 522, 532 are used to attach the VIPs 512, 514 (may include the PU foam 516, 518) to the inside skin 530 and the outside skin 520 of the side wall 500. In one implementation, the inside skin 530 and the outside skin 520 of the roof 500 are formed with composite liners.

Figure 5B:
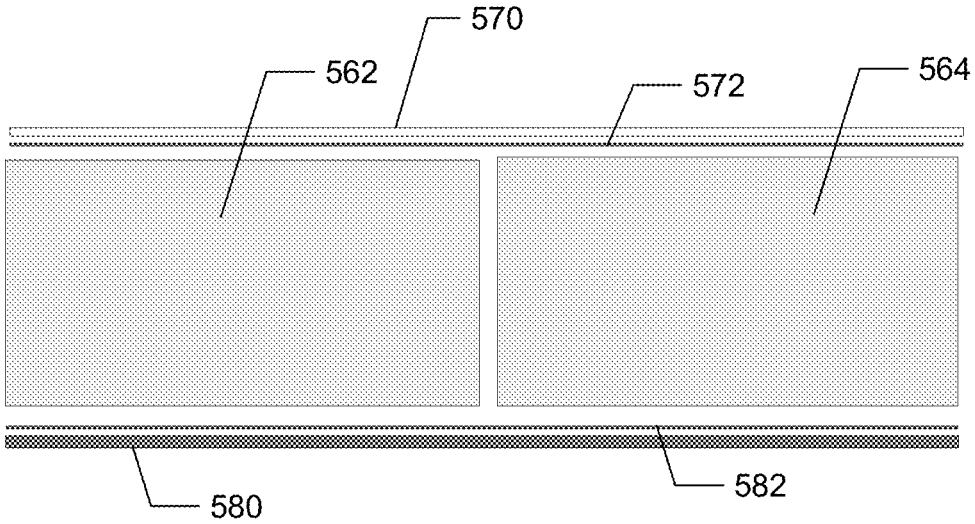
FIG. 5B is a cross-sectional view of a side wall of a refrigerated trailer having thermal insulation including VIPs in accordance with a seventh implementation of the side wall of the present disclosure.

FIG. 5B is a cross-sectional view of a side wall 550 (or roof) of a refrigerated trailer having thermal insulation including VIPs 562, 564 in accordance with a seventh implementation of the side wall of the present disclosure. Unlike the sixth implementation, the VIPs 562, 564 of the seventh implementation are not encapsulated and does not include a composite structural post.

In the seventh implementation of the side wall, adhesives 572, 582 are used to attach the VIPs 562, 564 to the inside skin 580 and the outside skin 570 of the roof 550. In one implementation, the inside skin 580 and the outside skin 570 of the side wall 550 are formed with composite liners.

The benefits of the above-described changes made to the side walls and roofs of the refrigerated trailers include: (a) increased cargo capacity due to the decreased dimension of the depth of the walls and roofs (i.e., thinner walls and roofs); (b) decreased usage of Transport Refrigeration Unit (TRU) of the refrigerated trailer due to improved thermal properties; (c) reduced usage of specialized production lines which simplifies assembly; and (d) ease of maintenance due to usage of VIPs that can be easily swapped out.

Figure 6A:
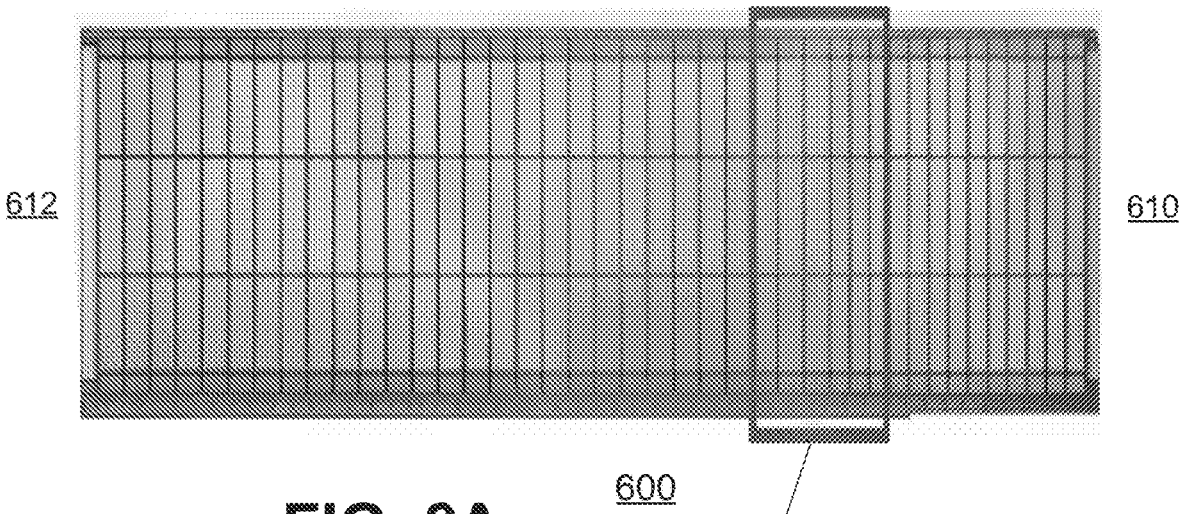
FIG. 6A is a side view of a side wall of a refrigerated trailer having thermal insulation in accordance with one implementation of the present disclosure.

FIG. 6A is a side view of a side wall 600 of a refrigerated trailer having thermal insulation in accordance with one implementation of the present disclosure. FIG. 6A illustrates the side view of the side wall 600 with the front 610 of the trailer on the right side, and the back 612 of the trailer on the left side.

Figure 6B:
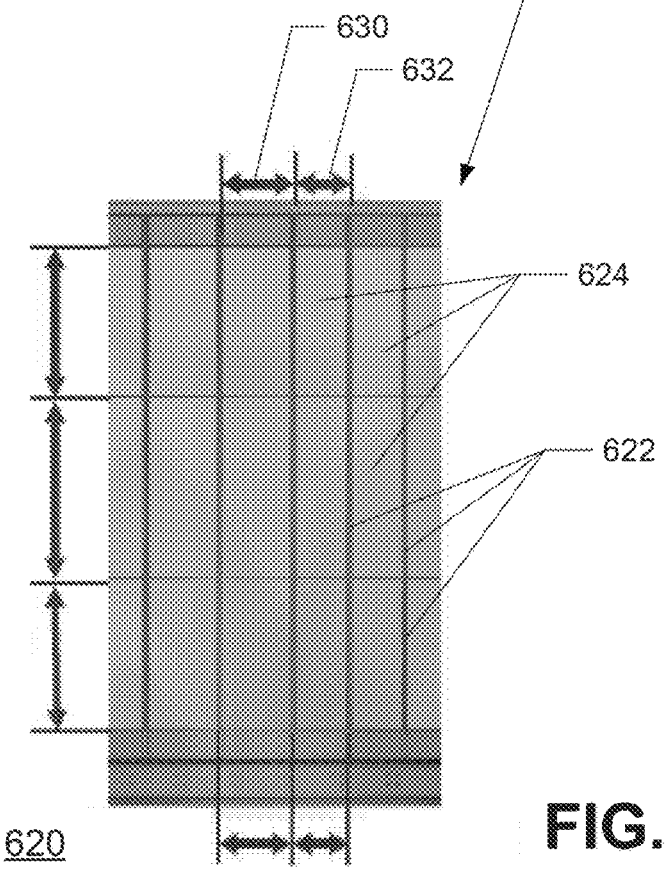
FIG. 6B is a detailed view of a portion of the side wall in accordance with one implementation of the present disclosure.

FIG. 6B is a detailed view of a portion 620 of the side wall 600 in accordance with one implementation of the present disclosure. FIG. 6B illustrates an array of composite structural posts 622 and an array of VIPs 624.

Figure 7A:
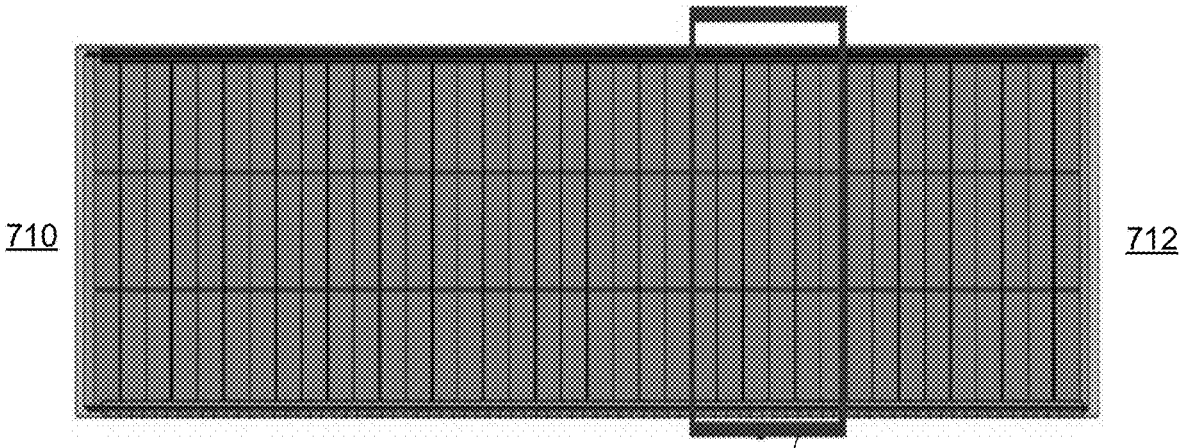
FIG. 7A is a top view of a roof of a refrigerated trailer having thermal insulation in accordance with one implementation of the present disclosure.

FIG. 7A is a top view of a roof 700 of a refrigerated trailer having thermal insulation in accordance with one implementation of the present disclosure. FIG. 7A illustrates the top view of the roof 700 with the front 710 of the trailer on the left side, and the back 712 of the trailer on the right side.

Figure 7B:
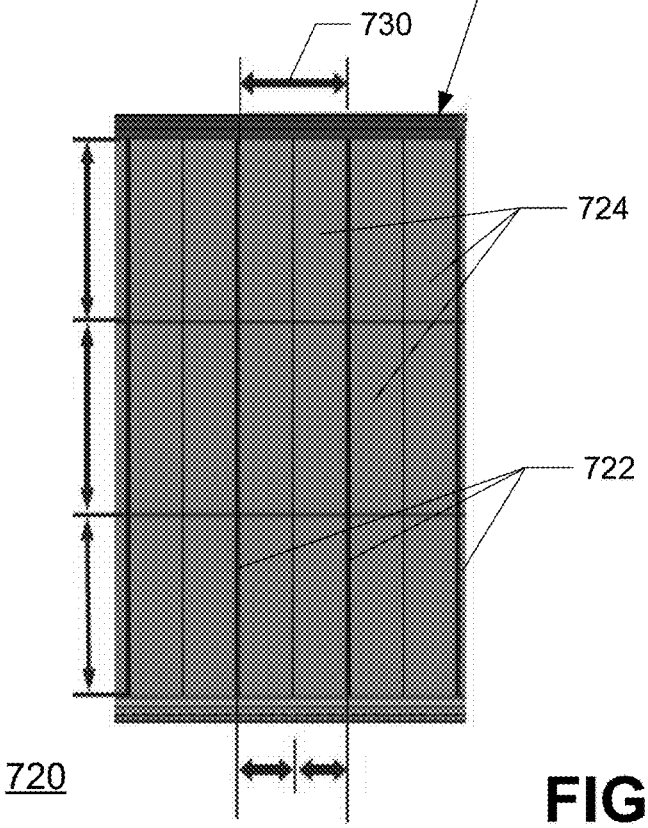
FIG. 7B is a detailed view of a portion of the roof in accordance with one implementation of the present disclosure.

FIG. 7B is a detailed view of a portion 720 of the roof 700 in accordance with one implementation of the present disclosure. FIG. 7B illustrates an array of composite structural posts 722 (sometimes referred to as bows) and an array of VIPs 724.

In one particular implementation, a refrigerated trailer having thermal insulation is disclosed. The refrigerated trailer includes: (1) a plurality of side walls, wherein each side wall includes: (a) a first plurality of vacuum insulated panels (VIPs), each VIP of the first plurality of VIPs made of thermal resistant and porous material; and (2) a roof including: (a) a second plurality of VIPs, each VIP of the second plurality of VIPS made of thermal resistant and porous material; and (b) a second plurality of structural posts, each structural post of the second plurality of structural posts made of composite material, the second plurality of structural posts arranged in a horizontal bow configuration to hold the second plurality of VIPs in place to form a roof.

In one implementation, the refrigerated trailer further includes a first plurality of structural posts, each structural post of the first plurality of structural posts made of composite material. In one implementation, the first plurality of structural posts is arranged in a vertical configuration to hold the plurality of VIPs in place to form a wall. In one implementation, the refrigerated trailer further includes a first plurality of polyurethane (PU) foams disposed within each side wall, each of the first plurality of PU foams configured to encapsulate each VIP of the first plurality of VIPs. In one implementation, the refrigerated trailer further includes a second plurality of PU foams disposed within the roof, each of the second plurality of PU foams configured to encapsulate each VIP of the second plurality of VIPs. In one implementation, the refrigerated trailer further includes: an outside skin for each side wall, wherein the outside skin is made of an aluminum sheet; and an inside skin for each side wall, wherein the inside skin is made of a thermoplastic liner. In one implementation, the inside skin for each side wall includes multiple pieces bent and joined at a lap joint using fasteners. In one implementation, the inside skin for each side wall includes multiple pieces joined at a joint using fasteners. In one implementation, the inside skin for each side wall includes multiple pieces joined with adhesives. In one implementation, the refrigerated trailer further includes adhesives used to attach the first plurality of structural posts and the first plurality of VIPs to the inside skin and the outside skin of each side wall. In one implementation, the refrigerated trailer further includes: an outside skin for the roof, wherein the outside skin is made of an aluminum sheet; and an inside skin for the roof, wherein the inside skin is made of a thermoplastic liner. In one implementation, the refrigerated trailer further includes: an outside skin for the roof, wherein the outside skin is made of an aluminum sheet; and an inside skin for the roof, wherein the inside skin is made of a composite liner. In one implementation, the refrigerated trailer further includes adhesives used to attach the second plurality of structural posts and the second plurality of VIPs to the inside skin and the outside skin of the roof. In one implementation, each structural post of the first plurality of structural posts and the second plurality of structural posts is a square shape.

In one particular implementation, a refrigerated trailer includes: (1) a pair of side walls, each side wall including: (a) first multiple VIPs, wherein each VIP is made of insulants made up of a rigid, highly-porous core material encased in a thin, gas-tight outer envelope; (b) composite wall posts arranged in a vertical configuration to hold the first multiple VIPs in place to form the pair of side walls; and (2) a roof including: (a) second multiple VIPs, wherein each VIP is made of insulants made up of a rigid, highly-porous core material encased in a thin, gas-tight outer envelope; (b) composite roof posts arranged in a horizontal bow configuration to hold the second multiple VIPs in place to form the roof.

In one implementation, the refrigerated trailer further includes multiple PU foams, wherein each PU foam is configured to encapsulate each VIP of the first multiple VIPs and the second multiple VIPs. In one implementation, the refrigerated trailer further includes: an outside skin for each of the pair of side walls and the roof, wherein the outside skin is made of an aluminum sheet; and an inside skin for each of the pair of side walls and the roof, wherein the inside skin is made of a thermoplastic liner. In one implementation, the refrigerated trailer further includes: an outside skin for each of the pair of side walls and the roof, wherein the outside skin is made of an aluminum sheet; and an inside skin for each of the pair of side walls and the roof, wherein the inside skin is made of a composite liner. In one implementation, both the inside skin and the outside skin are made of composite liners. In one implementation, the refrigerated trailer further includes adhesives used to attach the composite wall posts, the composite roof posts, the first multiple VIPs and the second multiple VIPs to the inside skin and the outside skin of each of the pair of side walls and the roof. In one implementation, each post of the composite wall posts and the composite roof bow.

All features of each of the above-discussed examples are not necessarily required in a particular implementation of the present disclosure. Further, it is to be understood that the description and drawings presented herein are representative of the subject matter which is broadly contemplated by the present disclosure. It is further understood that the scope of the present disclosure fully encompasses other implementations that may become obvious to those skilled in the art and that the scope of the present disclosure is accordingly limited by nothing other than the appended claims.

The invention claimed is:

1. A refrigerated trailer having thermal insulation, the refrigerated trailer comprising:

a plurality of side walls, wherein each side wall includes:

a first plurality of vacuum insulated panels (VIPs), each VIP of the first plurality of VIPs made of thermal resistant and porous material; and a roof including:

a second plurality of VIPs, each VIP of the second plurality of VIPs made of thermal resistant and porous material;

a plurality of structural posts, each structural post of the plurality of structural posts made of composite material, and the plurality of structural posts arranged in a horizontal bow configuration to hold the second plurality of VIPs in place to form a roof.

2. The refrigerated trailer of claim 1, further comprising a second plurality of structural posts, each structural post of the second plurality of structural posts made of composite material.

3. The refrigerated trailer of claim 2, wherein the second plurality of structural posts is arranged in a vertical configuration to hold the first plurality of VIPs in place to form a wall.

4. The refrigerated trailer of claim 2, wherein each structural post of the plurality of structural posts and the second plurality of structural posts is a square shape.

5. The refrigerated trailer of claim 1, further comprising a first plurality of polyurethane (PU) foams disposed within each side wall, each of the first plurality of PU foams configured to encapsulate each VIP of the first plurality of VIPs.

6. The refrigerated trailer of claim 5, further comprising a second plurality of PU foams disposed within the roof, each of the second plurality of PU foams configured to encapsulate each VIP of the second plurality of VIPs.

7. The refrigerated trailer of claim 1, further comprising:

an outside skin for each side wall, wherein the outside skin is made of an aluminum sheet; and an inside skin for each side wall, wherein the inside skin is made of a thermoplastic liner.

8. The refrigerated trailer of claim 7, wherein the inside skin for each side wall includes multiple pieces bent and joined at a lap joint using fasteners.

9. The refrigerated trailer of claim 7, wherein the inside skin for each side wall includes multiple pieces joined at a joint using fasteners.

10. The refrigerated trailer of claim 7, wherein the inside skin for each side wall includes multiple pieces joined with adhesives.

11. The refrigerated trailer of claim 7, further comprising adhesives used to attach a first plurality of structural posts and the first plurality of VIPs to the inside skin and the outside skin of each side wall.

12. The refrigerated trailer of claim 1, further comprising:

an outside skin for the roof, wherein the outside skin is made of an aluminum sheet; and an inside skin for the roof, wherein the inside skin is made of a thermoplastic liner.

13. The refrigerated trailer of claim 12, further comprising adhesives used to attach the plurality of structural posts and the second plurality of VIPs to the inside skin and the outside skin of the roof.

14. The refrigerated trailer of claim 1, further comprising:

an outside skin for the roof, wherein the outside skin is made of an aluminum sheet; and an inside skin for the roof, wherein the inside skin is made of a composite liner.

15. The refrigerated trailer of claim 1, further comprising:

an outside skin for each side wall, wherein the outside skin is made of a first composite liner; and an inside skin for each side wall, wherein the inside skin is made of a second composite liner.

16. A refrigerated trailer comprising:

a pair of side walls, each side wall including:

first multiple VIPs, wherein each VIP is made of insulants made up of a rigid, highly-porous core material encased in a thin, gas-tight outer envelope; and composite wall posts arranged in a vertical configuration to hold the first multiple VIPs in place to form the pair of side walls; and a roof including:

second multiple VIPs, wherein each VIP is made of insulants made up of a rigid, highly-porous core material encased in a thin, gas-tight outer envelope; and composite roof posts arranged in a horizontal bow configuration to hold the second multiple VIPs in place to form the roof.

17. The refrigerated trailer of claim 16, further comprising multiple polyurethane (PU) foams, wherein each PU foam is configured to encapsulate each VIP of the first multiple VIPs and the second multiple VIPs.

18. The refrigerated trailer of claim 16, further comprising:

an outside skin for each of the pair of side walls and the roof, wherein the outside skin is made of an aluminum sheet; and an inside skin for each of the pair of side walls and the roof, wherein the inside skin is made of a thermoplastic liner.

19. The refrigerated trailer of claim 16, further comprising:

an outside skin for each of the pair of side walls and the roof, wherein the outside skin is made of an aluminum sheet; and an inside skin for each of the pair of side walls and the roof, wherein the inside skin is made of a composite liner.

20. The refrigerated trailer of claim 19, further comprising adhesives used to attach the composite wall posts, the composite roof posts, the first multiple VIPs and the second multiple VIPs to the inside skin and the outside skin of each of the pair of side walls and the roof.

21. The refrigerated trailer of claim 16, wherein each post of the composite wall posts and the composite roof bow.

* * * * *